US010450793B2

(12) United States Patent
Campbell

(10) Patent No.: US 10,450,793 B2
(45) Date of Patent: Oct. 22, 2019

(54) SECURITY PANEL FRAMING SYSTEM AND METHOD

(71) Applicant: Brad Campbell, Huntington Beach, CA (US)

(72) Inventor: Brad Campbell, Huntington Beach, CA (US)

( * ) Notice: Subject to any disclaimer, the term of this patent is extended or adjusted under 35 U.S.C. 154(b) by 0 days.

(21) Appl. No.: 15/909,935

(22) Filed: Mar. 1, 2018

(65) Prior Publication Data

US 2018/0258687 A1 Sep. 13, 2018

Related U.S. Application Data

(60) Provisional application No. 62/468,882, filed on Mar. 8, 2017.

(51) Int. Cl.

| | |
|---|---|
| ***E06B 5/10*** | (2006.01) |
| ***E06B 1/36*** | (2006.01) |
| ***E06B 1/60*** | (2006.01) |
| ***E06B 1/28*** | (2006.01) |
| ***E06B 5/11*** | (2006.01) |
| ***E06B 1/34*** | (2006.01) |
| ***E06B 3/58*** | (2006.01) |

(52) U.S. Cl.

CPC ..... *E06B 5/106* (2013.01); *E06B 1/28* (2013.01); *E06B 1/34* (2013.01); *E06B 1/366* (2013.01); *E06B 1/6069* (2013.01); *E06B 3/5828* (2013.01); *E06B 5/11* (2013.01); *E06B 5/116* (2013.01)

(58) Field of Classification Search

CPC ..... E06B 5/106; E06B 3/5828; E06B 5/116; E06B 1/34; E06B 5/11; E06B 1/6069; E06B 1/366; E06B 1/28

See application file for complete search history.

(56) References Cited

U.S. PATENT DOCUMENTS

| | | | | |
|---|---|---|---|---|
| 4,187,657 A * | 2/1980 | Sukolics | ..... | E06B 3/12 49/DIG. 1 |
| 5,636,484 A * | 6/1997 | DeBlock | ..... | E06B 3/5892 52/171.1 |
| 6,293,049 B1 * | 9/2001 | Shaw | ..... | E06B 1/366 49/183 |

(Continued)

OTHER PUBLICATIONS

Hammerglass Add-On System F, 2015, Forslov, Sweden.

*Primary Examiner* — Patrick J Maestri

(74) *Attorney, Agent, or Firm* — Cionca IP Law P.C.; Marin Cionca

(57) ABSTRACT

A security panel framing system having a base frame; a base plate under a base frame bottom side, the base plate having a stopper; a hollow inner channel defined by the base frame; a wedge having a wedge top side, and a wedge bottom side; a wedge wall extending between the wedge top side and the wedge bottom side; a reinforced end at the wedge bottom side; wherein the reinforced end and a bottom wedge lip are configured to be held in place by the stopper; a cap configured to be associated with the wedge; and wherein the wedge is configured to sit at a base plate front side leaving a gap between the wedge back side and the base frame, the gap being configured to receive a security panel, such that the security panel is snugly encased by the base frame and the wedge.

20 Claims, 13 Drawing Sheets

(56) References Cited

U.S. PATENT DOCUMENTS

| | | | | |
|---|---|---|---|---|
| 8,490,350 | B1 * | 7/2013 | Greely | E06B 1/34 52/211 |
| 9,657,513 | B1 * | 5/2017 | Kapiloff | E06B 5/10 |
| 2016/0145934 | A1 | 5/2016 | Trott | |
| 2016/0298938 | A1 | 10/2016 | Trott | |

* cited by examiner

SECURITY PANEL FRAMING SYSTEM AND METHOD

CROSS-REFERENCE TO RELATED APPLICATIONS

This application claims the benefit of U.S. Provisional Application No. 62/468,882, filed Mar. 8, 2017, which is hereby incorporated by reference, to the extent that it is not conflicting with the present application.

BACKGROUND OF INVENTION

1. Field of the Invention

The invention relates generally to security window technology and more particularly to a system and method for upgrading existing windows to withstand attacks and other types of damage.

2. Description of the Related Art

The typical window has a frame in which a glass panel is installed. The glass is typically easily breakable. Banks and other commercial establishments often need windows that can withstand an attack from an intruder or a bullet, for example. Some residents may also wish to upgrade their windows for security or safety purposes.

The existing framing solutions that address this problem appear to be merely improvised assemblies of existing parts that are openly available on the market. Further, these improvised assemblies often use only adhesive tape to connect to the existing window frame, which can be problematic and can potentially fail, especially when the existing window frame is not in good condition due to oxidation, failing paint, or corrosion. These assemblies also need to be installed when the temperature is warm, which limits their use for much of the year in certain climate zones. Such improvisations do not appear to be strong enough for the intended purpose of added security or safety in many cases. As a result, there appears to be a high likelihood that such improvisations would fail when exposed to a serious attack. Another issue in existing systems for adding a security system to windows is that bolts or other means for fastening the security system are exposed, and are made of steel. The exposed bolts can be unsightly, and anodized aluminum or other such materials may be preferred for the construction of such fasteners, but are not available to users.

Retailers selling a security system for windows or other users providing such a security system may also require different quantities of the base of the frame than they require of the leg of the frame. A solution may be needed for providing these portions of the system separately, since storage may be an issue for users who are left with an excess of the leg portions when more of the base portion is needed.

Thus, there is a need for a new and improved security panel framing system and method that solves the problems outlined above, and is unique and professional.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an embodiment, a security panel framing system is provided, which includes a base, a wedge, and a cosmetic cap, all three elements fitting together to provide a secure, unique, cosmetically viable and pleasing appearance that blends seamlessly with existing commercial or residential glass framing. In some cases, the wedge and cap may be used without the base if the existing window frame has a component that serves the same purpose as the base, thereby eliminating the need for the base. In these cases, the wedge and cap are used as a stand-alone product.

In another aspect, a security panel framing system is provided, comprising: a base having: a base frame having a base frame front side, a base frame back side, a base frame top side, and a base frame bottom side; a base plate under the base frame bottom side and extending past the base frame front side, the base plate having a base plate front side, a base plate back side, a base plate top side, a base plate bottom side, and a stopper at the base plate front side; a plurality of legs along and extending downwards from the base plate bottom side, such that a plurality of spaces is formed between the legs, wherein a first leg of the plurality of legs is substantially aligned with the stopper, and wherein at least one space of the plurality of spaces is larger than the other spaces of the plurality of spaces; a hollow inner channel defined by the base frame front side, the base frame back side, the base frame top side, and the base frame bottom side; a wedge having: a wedge front side, a wedge back side, a wedge top side, and a wedge bottom side; an upper wedge lip at the wedge top side; a wedge wall extending between the wedge top side and the wedge bottom side; a reinforced end at the wedge bottom side; a lower wedge lip above the reinforced end; wherein the reinforced end and the bottom wedge lip are configured to fit around and be held in place by the stopper; and a cap configured to be associated with the wedge front side by having a plurality of prongs corresponding with the upper wedge lip and the lower wedge lip, wherein the cap covers a front end of the security panel framing system; an wherein the wedge is configured to sit at the base plate front side leaving a gap between the wedge back side and the base frame front side, the gap being configured to receive a portion of a security panel, such that the portion of the security panel is snugly encased by the base frame and the wedge. An advantage is that a protective security panel can be installed securely against a window or other glass panel and can be custom fit to any size window or glass panel. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look. Another advantage may be that bugs, dust, water, or other contaminants may be blocked from entering the system or prevented from damaging the system by the sealant and desiccant.

In another aspect, a security panel framing system is provided, comprising: a wedge having: a wedge front side, a wedge back side, a wedge top side, and a wedge bottom side; a wedge wall extending between the wedge top side and the wedge bottom side; an upper wedge lip at the wedge top side; a reinforced end at the wedge bottom side; a lower wedge lip above the reinforced end; wherein the reinforced end and the bottom wedge lip are configured to fit around and be held in place by the stopper; and a cap configured to be associated with the wedge front side by having a plurality of prongs, wherein the cap covers a front end of the security panel framing system; and wherein the wedge back side is configured to align against a security panel, such that a portion of the security panel is snug against the wedge back side. Again, an advantage is that a protective security panel can be installed securely against a window or other glass panel and can be custom fit to any size window or glass panel, or an existing security panel can have securing means such as bolts or screws obscured from view by using the wedge and the cap. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look.

In another aspect, a method of installing a security panel on a frame for a glass is provided, using a security panel framing system comprising: a base having: a base frame having a base frame front side, a base frame back side, a base frame top side, and a base frame bottom side; a base plate under the base frame bottom side and extending past the base frame front side, the base plate having a base plate front side, a base plate back side, a base plate top side, a base plate bottom side, and a stopper at the base plate front side; a plurality of legs along and extending downwards from the base plate bottom side, such that a plurality of spaces is formed between the legs, wherein a first leg of the plurality of legs is substantially aligned with the stopper, and wherein at least one space of the plurality of spaces is larger than the other spaces of the plurality of spaces; a hollow inner channel defined by the base frame front side, the base frame back side, the base frame top side, and the base frame bottom side; a wedge having: a wedge front side, a wedge back side, a wedge top side, and a wedge bottom side; a wedge wall extending between the wedge top side and the wedge bottom side; an upper wedge lip at the wedge top side; a reinforced end at the wedge bottom side; a lower wedge lip above the reinforced end; wherein the reinforced end and the bottom wedge lip are configured to fit around and be held in place by the stopper; and a cap configured to be associated with the wedge, wherein the cap covers a front end of the security panel framing system; and wherein the wedge is configured to sit at the base plate front side leaving a gap between the wedge back side and the base frame front side, the gap being configured to receive a portion of a security panel, such that the portion of the security panel is snugly encased by the base frame and the wedge; the method comprising the steps of: measuring the frame for a glass to obtain a first length; associating the base, the wedge, and the cap together into a unit; cutting the base, the wedge, and the cap such that a length of the unit matches the first length; applying the sealant to the base plate bottom side; securing the base to the frame for a glass; providing a security panel sized to fit the frame for a glass; holding the security panel in place on top of the base plate and against the base frame; placing the wedge; holding the cap against the wedge; and pushing a force on the cap to associate the cap with the wedge. Again, an advantage is that a protective security panel can be installed securely against a window or other glass panel and can be custom fit to any size window or glass panel. Another advantage may be that the security panel framing system is durable and can withstand damage or attack. Another advantage may be that the appearance of the security panel framing system is seamless and can blend into existing framing, and screw heads are hidden from view to provide a more aesthetically pleasing look. Another advantage may be that bugs, dust, water, or other contaminants may be blocked from entering the system or prevented from damaging the system by the sealant.

The above embodiment(s), aspects and advantages, as well as other embodiment(s), aspects and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
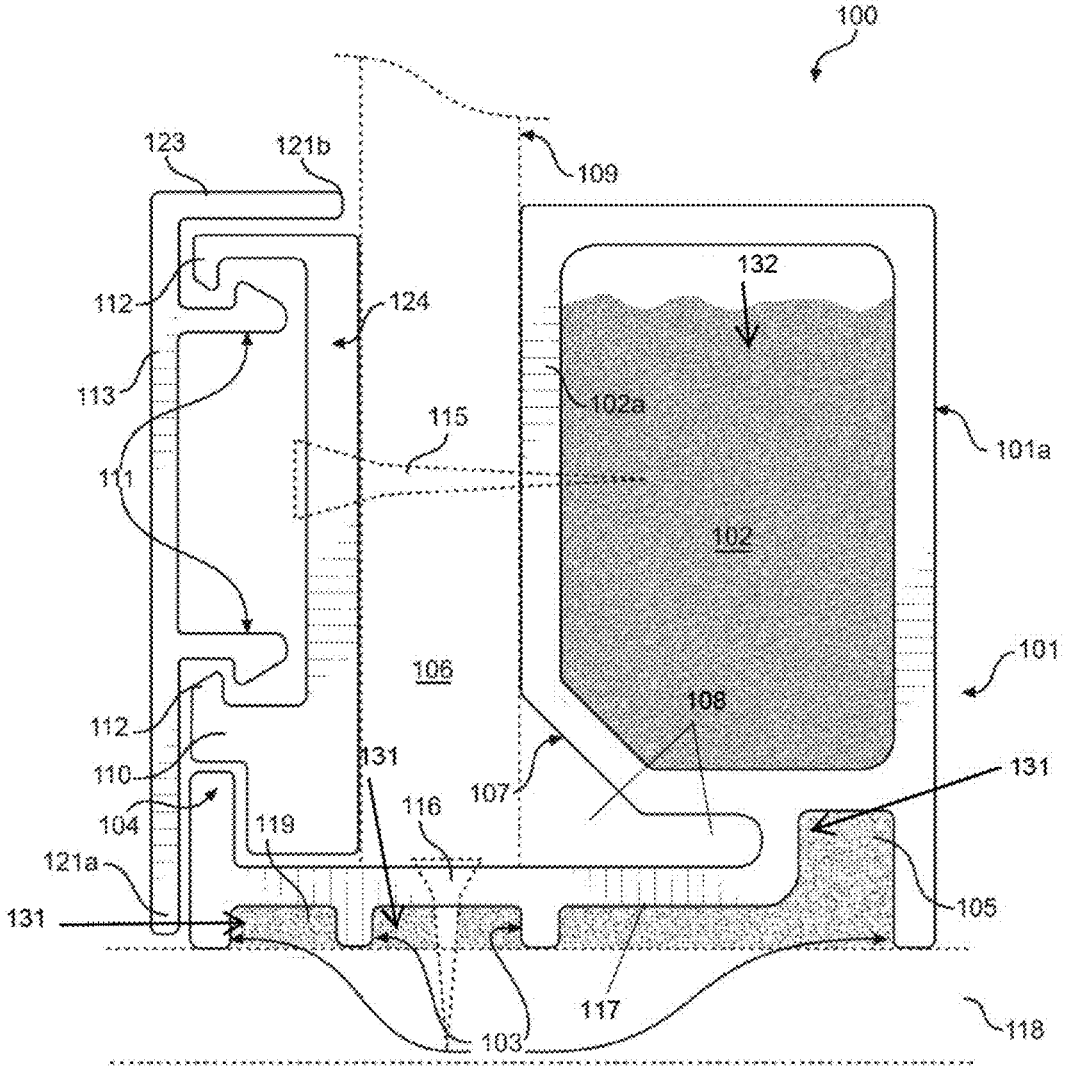
FIG. 1 illustrates a cross-sectional side elevation view of a security panel framing system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 101 and 901, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a cross-sectional side elevation view of a security panel framing system ("security panel framing system," "security system," or "system") 100, according to an aspect. As shown, the security panel framing system 100 may include a base 101, a wedge 110, and a cosmetic cap ("cosmetic cap," "cover," or "cap") 113, all three elements fitting together to provide a secure, unique, cosmetically viable and pleasing appearance that may blend seamlessly with existing commercial or residential glass framing. The security panel framing system 100 can be used inside or outside of an existing glass framing to enhance their security attribute, as it will be described in detail hereinafter.

The security panel framing system 100 may be made from, for example, aluminum, which may, for example, be anodized or powder-coated colors to protect the aluminum from corrosion and the elements, or any other damage from the weather. Further, the system 100 may be offered in various colors of anodize to match existing glass framing. It should be understood that all parts or components of the security panel framing system 100 may be anodized, painted, powder coated, or otherwise colored by any other suitable means, and it should also be understood that all parts or components may thus be protected from corrosion or oxidation. It should be understood that all parts or components may also be provided in its raw aluminum milled finish, with no additional finish applied.

The base ("base" or "base element") 101 may be comprised of a base frame 101*a* and a base plate 117. The base frame may be a five-sided element 101*a* having five sides when viewed from a side elevation view as shown in FIG. 1. The five-sided element 101*a* may have a front side, a back side, a top side, and a bottom side. The bottom side may include a slanted edge or side ("slanted edge," or "slanted side") 107 such that two sides of the five-sided element are along the bottom side of the base frame, and the front side may face the wedge 110. The base plate 117 may be positioned underneath the bottom side of the base frame 101*a*. The wedge 110 may also have a front side, a back side, a top side, and a bottom side. When the security panel framing system 100 receives a security panel 109, the security panel 109 may be fitted snugly against the back side of the wedge 110 and the front side of the base frame 101*a* of the base 101.

The base element 101 may have a raised base plate 117, which may be raised using a plurality of protrusions or legs ("protrusions" or "legs") 103. The raised configuration of the base 101 and base plate 117 may allow for a sealant 131 to fill the spaces 119 created by the protrusions 103, base plate 117 and an existing glass/window frame 118, to better secure the system 100 to an existing frame 118 for a glass panel, such as a window. Additionally, the sealant 131 can help to also seal out water, bugs and dust. A screw 116 may also be used to help secure the system 100 to the existing glass frame 118, in addition to the sealant. An additional benefit of the raised configuration of the base plate 117 is that it may also prevent the screw 116 from bending or warping the base plate 117 as the screw 116 is tightened down into the existing glass frame 118. Further, the height of the protrusions 103 can control how much seal/glue will be left between the base plate 117 and the existing glass/window frame 118, thus controlling the strength of the bond between the two elements. Moreover, it should be noted that at least one recess ("recess" or "larger space") 105 may be provided that is larger than the rest of the spaces 119, to reduce the material (e.g., aluminum) needed and while still increasing the strength of the base. This configuration may also prevent water from infiltrating into the cavity or inner hollow channel ("inner hollow channel," "hollow channel," or "inner channel") 102 where desiccant 132 may be held in case of heavy rain or other unusually heavy water event such as a flood of some sort. Also, the slanted side 107 of the base 101 and the spaces may help evacuate or drain water should the system be flooded in heavy sheeting rain or a flood of some sort, for example. This design may also give maximum strength to the system 100 while also reducing the amount of aluminum that would be needed in an alternative embodiment where these areas are solid aluminum. Since the cost of the system may largely be based on the weight of aluminum used, the structural configuration provided may be efficient in the sense that it provides maximum strength with the least amount of aluminum possible.

It should be understood that a plurality of screws 116 may be used as necessary. For example, screws can be placed every 6 (six) inches along the entire length (shown by 220 in FIG. 2A) of the base plate 117. Their use in addition to the sealant may be preferred because it may result in an enhanced bond between the base plate 117 and the existing glass frame 118, thereby making the system less likely to fail during a forceful entry attempt by, for example, a burglar or active shooter.

The base 101 may have an inner hollow channel 102, which can receive and be filled with, completely or partially, a desiccant 132 to absorb moisture between the existing window glass 118 and the security panel 109. The moisture may be absorbed and allowed in via holes (not shown), which can be drilled at the installation site, for example. The holes may be drilled on the bottom framing component only and spaced for example every 12" to 18" (one hole every 12-18"). The amount of desiccant 132 used may depend on the size of the window, the size of the gap between the existing glass and the security panel and the climate zone where the building is located. Again, as described above, the base 101 is also formed (see spaces 108) for minimizing aluminum needed and for drainage, to allow water to drain away from the desiccant cavity. Silica beads or any other suitable desiccant may be used, for example, and any suitable desiccant may be placed into the hollow inner channel 102 by, for example, a funnel, or any other suitable means.

To install the security panel framing system 100, first, all three parts (i.e., base 101, wedge 110 and cap/cover 113) may be taped together and cut so that their length (shown by 220 in FIG. 2A) matches the specific window dimensions (e.g., left and right height and top and bottom width in the case of a rectangular window), so as to make sure they are all cut exactly the same length since they will be assembled to form one system. The system may thus be custom made or custom fitted to any size window or glass panel. It should be understood that, as an example, certain components, such as the base 101 and the legs 103 of the base may be provided separately, such that a user may custom fit the security panel framing system to their needs. As another example, a complete base 101 may be provided, and may be provided in a variety of sizes such that a user may choose the correctly sized base 101 for their needs.

Next, a sealant may be added to existing window frame 118 and/or the base plate 117 (on the protrusions side) and a desiccant may be added to the hollow channel 102 of the bottom frame only, preferably. Holes may be drilled every 12"-18" to allow for moisture to access the desiccant. A rubber grommet may be added to each hole for a cosmetic finish. Next, the base 101 may be screwed down using screw(s) 116 to the existing window frame 118. Again, the combined bonding effect of the sealant (which preferably seals and bonds) and of the screw(s) 116 results in a stronger link between the security panel framing system 100 and the existing window frame 118.

Next, once the base 101 has been installed on all sides, such as on all corners of the frame, and thus a security frame formed, a panel 109 may then be cut to size, added to the security frame and held in place by the installer or user until the wedge 110, and screws 115 can be added into a wall 124 of the wedge. The wedge may have holes pre-drilled in the center section along its entire length, usually every 6"-8", and one such hole may occur where screw 115 is shown as an example in FIG. 1. The holes may be sized to be just barely large enough for the screws 115 to travel through with no resistance, yet small enough to prevent the screw head from passing through, thus allowing the screw 115 to be tightened securely. Next the wedge 110 may be held into position against the security panel 109 and screws 115 may be driven through the pre-drilled holes, traveling through both the wedge 115 and the security panel 109 (e.g., through pre-drilled holes) and then into the base 101, approximately into the center of the innermost desiccant channel wall 102*a*, thus securing the security panel 109 to the base and thus to the existing window frame 118. Optionally, for increased strength and a better seal, a sealant can also be used in addition to screws 115, between the base 101 and the security panel 109 and/or between the security panel 109 and the wedge 110. A final bead of clear silicone may be used around the perimeter once the cap is installed. This clear bead may be very thin and virtually invisible, yet may prevent water from getting under the cap 113 in around the wedge. This clear silicone bead may be installed approximately in front of the protrusion 103 that is closest to the cap 113, such as at the location indicated by 121*a* as an example. Additionally another similar small thin bead of clear silicone may be used at the top of the cap 113 where it meets the security panel 109 for the same purpose, at the location indicated by 121*b* as an example. It should be understood that there may be slight gaps intentionally left in these two locations 121*a* and 121*b* to allow the clear silicone to properly seal in those areas to create a waterproof seal.

As shown in FIG. 1, the base plate 117 may have a lip or stopper ("base plate lip," "base plate stopper," or "stopper") 104 that blocks a reinforced (e.g., thicker, as shown) portion 114 of the wedge 110, thus preventing the wedge 110 from twisting or pulling away under pressure of an attack. This is important as the security panel 109 may incur significant "peel" and outward pressure when attacked, and this may be alleviated by the presence of the lip 104.

It can be noted in FIG. 1 that the configuration of the security panel framing system 100 may allow the outer edges of the security panel 109 to be encased snugly into the space 106 created by the base 101 and wedge 110. The security panel 109 may be constructed from any suitable material (e.g., polycarbonate, acrylic or similar or a combination of materials) for the security purpose sought (e.g., to prevent break in, bulletproof, etc.). Further examples of materials for the security panel 109 may include thermoplastic, laminated glass, or other types of plastics. Such materials may be containment-grade, and may have ballistic or non-ballistic ratings.

After following the steps described hereinbefore, the base 101, the security panel 109 and the wedge 110 may all be solidly attached to the window frame 118, creating a shield that prevents a criminal from gaining access to a building. In the case of a ballistic panel being added, bullets may be prevented from passing through.

Next, a water-resistant sealant may be applied around the edge of the framing and security panel and tooled to a cosmetic finish.

Lastly, a cap or cover 113 may be snapped into place as it is specifically designed to do (as shown in FIG. 1). The cap 113 may forms a covering for the screw heads 115 to give a final, finished cosmetic look to the security panel framing system 100, and may contribute to a clean look to the system 100. As seen in FIG. 1, as an example, the cap 113 may be provided with three portions or protrusions that extend outwards: a top arm 123, and two prongs 111, which may be an upper prong and a lower prong. The upper and lower prongs 111 may be able to snap and lock into corresponding wedge lips 112 when the installer or user applies outside pressure to the cap 113. This can hold the cap 113 tightly and securely into place.

Figure 2A:
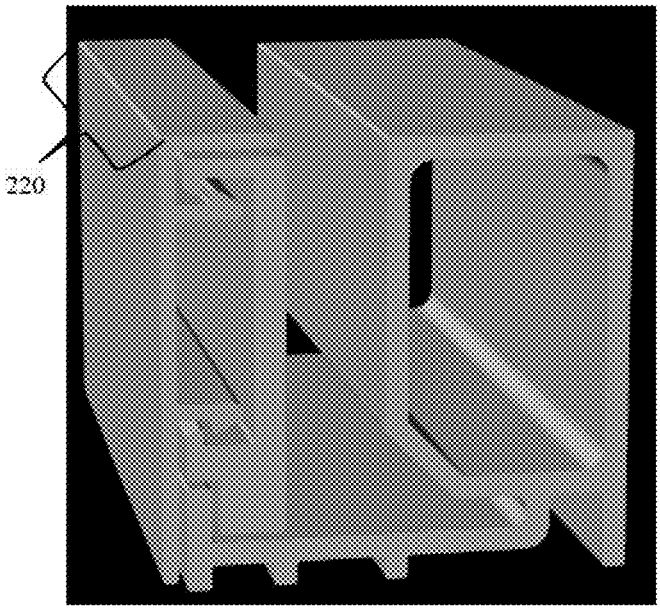
FIGS. 2A-2C illustrate various perspective views of the security panel framing system from FIG. 1, according to an aspect.
Figure 2B:
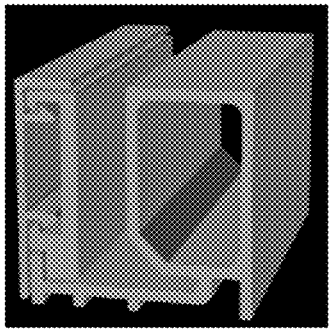
Figure 2C:
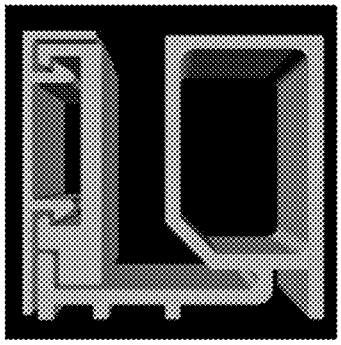

FIGS. 2A-2C illustrate various perspective views of the security panel framing system from FIG. 1, according to an aspect.

Figure 2D:
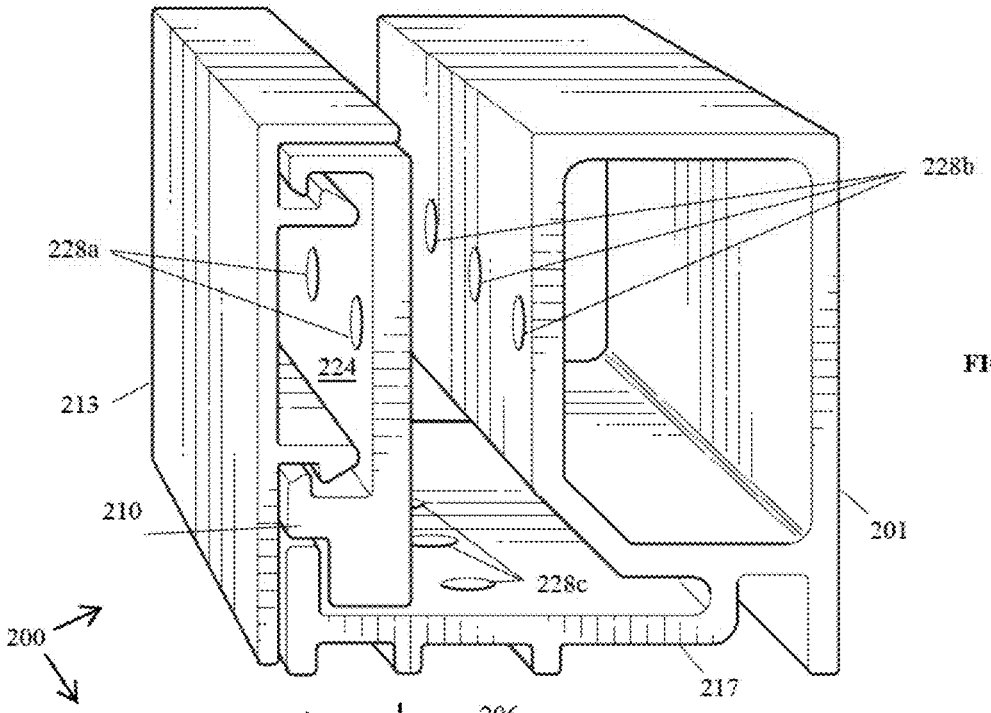
FIGS. 2D-2E illustrate perspective views of the security panel framing system, shown with provided screw holes, and shown with screws installed into the provided screw holes, respectively, according to an aspect.
Figure 2E:
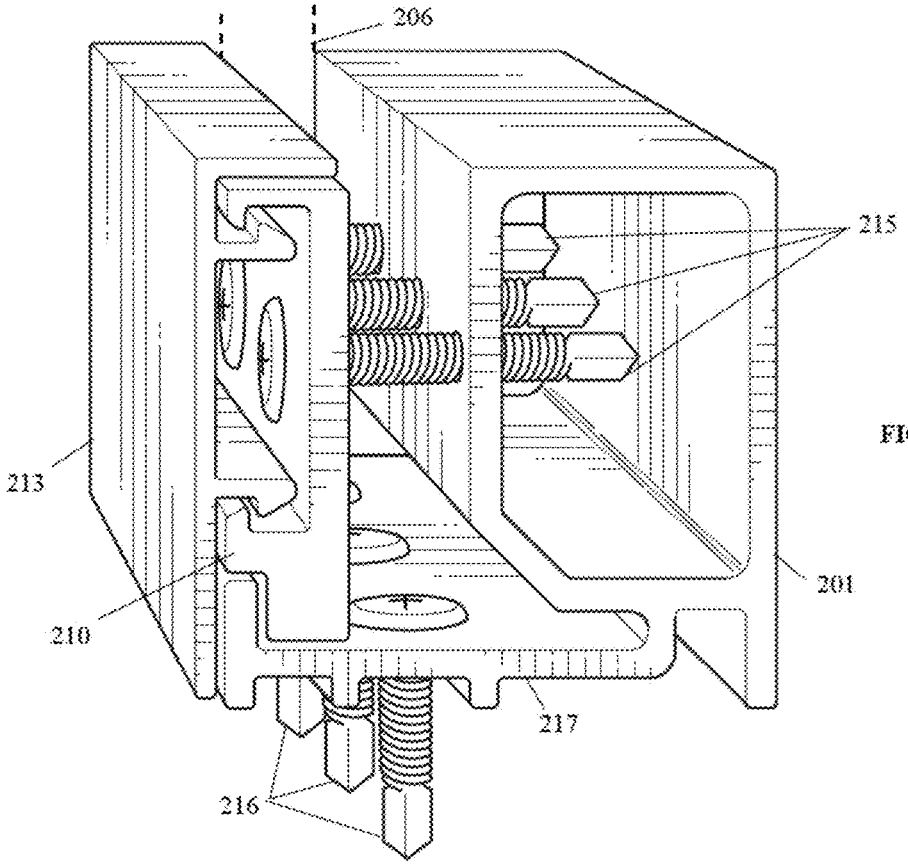

FIGS. 2D-2E illustrate perspective views of the security panel framing system 200 of FIGS. 1-2C, shown with provided screw holes 228*a*, 228*b*, and 228*c*, and shown with screws 215 and 216 installed into the provided screw holes 228*a*, 228*b*, and 228*c*, respectively, according to an aspect. A set of screw holes 228*a* may be provided in the wedge wall 224 of the wedge 210, and another set of screw holes 228*b* may be provided in the base 201, and another set of screw holes 228*c* may be provided in the base plate 217. The cap 213 may obscure or cover the screws once installed, as shown in FIG. 2E.

Figure 2F:
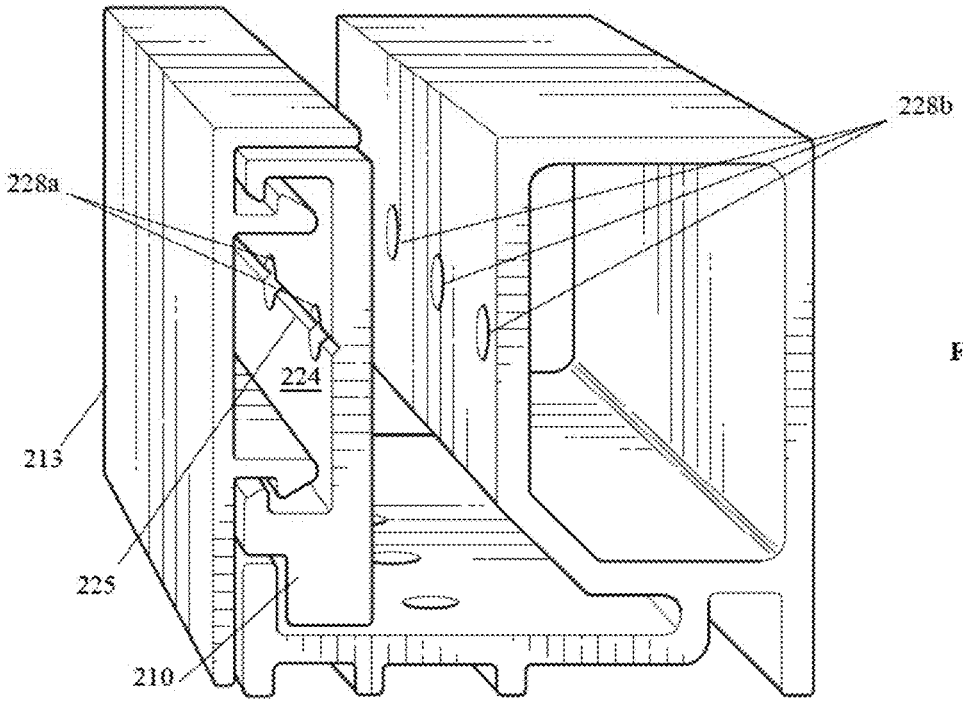
FIGS. 2F-2G illustrate perspective views of the security panel framing system, shown with provided screw holes, and shown with screws installed into the provided screw holes, respectively, wherein a groove is provided in the wedge wall, according to an aspect.
Figure 2G:
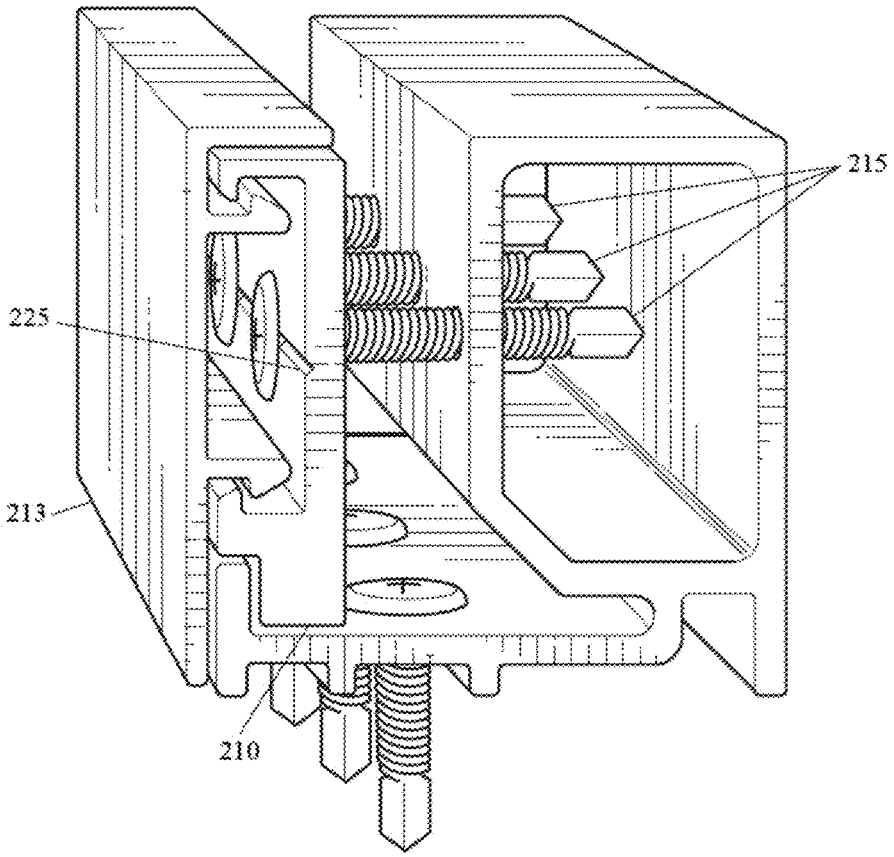

FIGS. 2F-2G illustrate perspective views of the security panel framing system 200 of FIGS. 1-2C, shown with provided screw holes 228*a*, 228*b*, and 228*c*, and shown with screws 215 and 216 installed into the provided screw holes 228*a*, 228*b*, and 228*c*, respectively, wherein a groove 225 is provided in the wedge wall 224, according to an aspect. The groove 225 is discussed further herein when referring to FIG. 8B. Screws 215 may pass through a security panel placed in the space presented by 206, which is shown and described in further detail when referring to FIG. 1.

Figure 3:
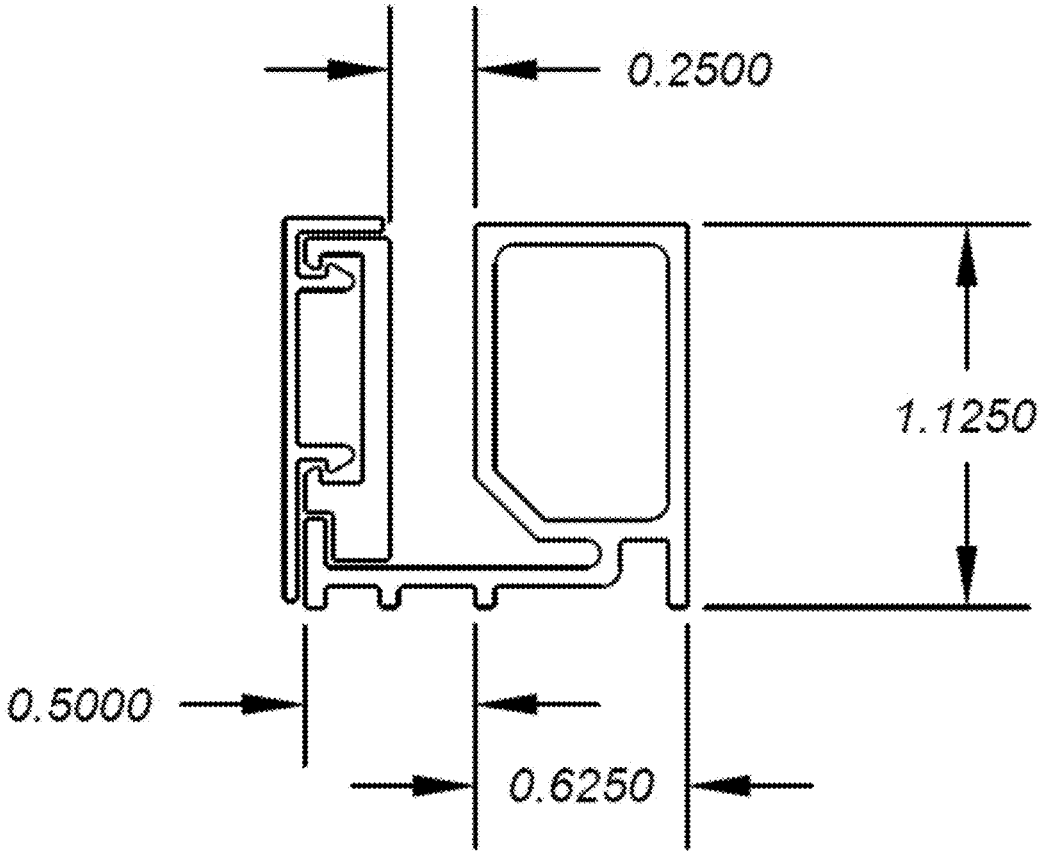
FIG. 3 shows exemplary dimensions for some portions of the security panel framing system from FIG. 1, according to an aspect.

FIG. 3 shows exemplary dimensions in inches for some portions of the security panel framing system from FIG. 1, according to an aspect.

Figure 4:
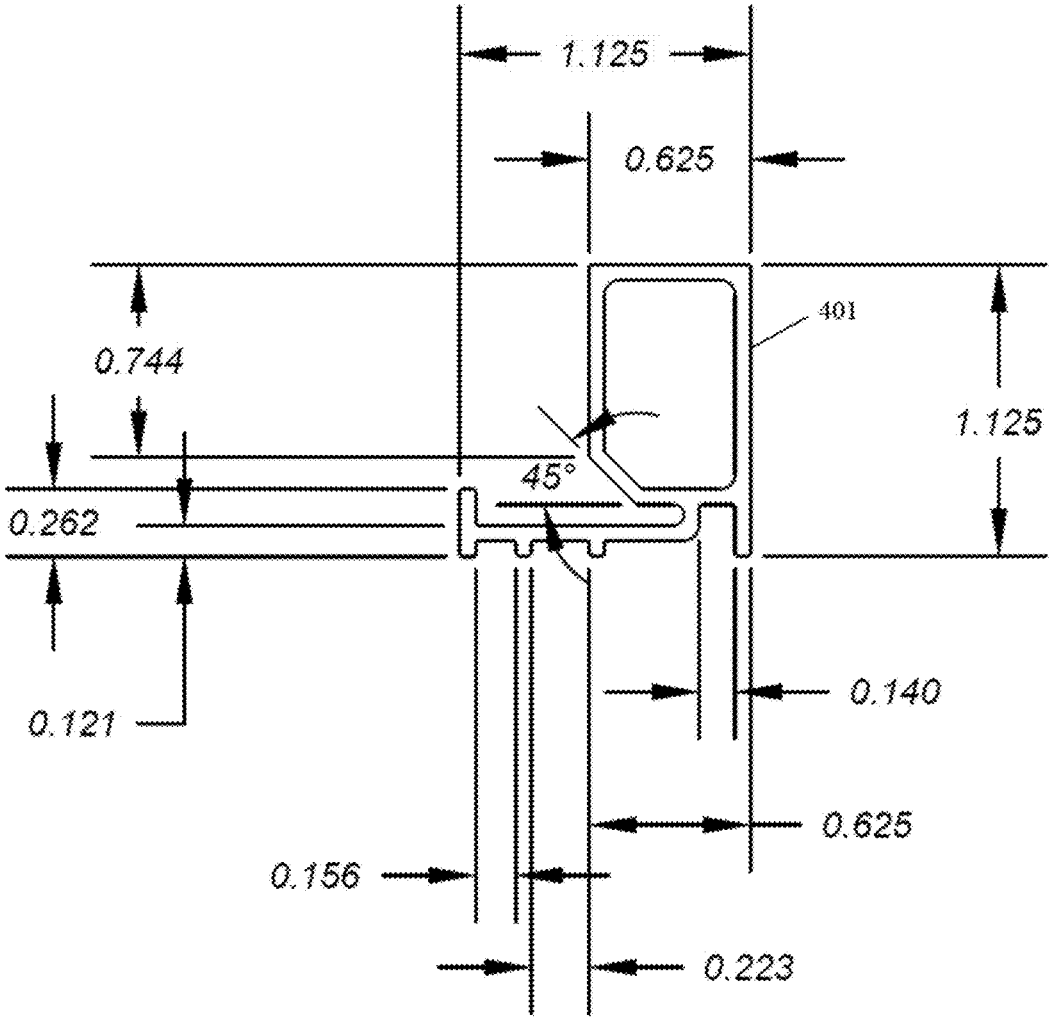
FIG. 4 illustrates the cross-sectional view of the base element of the security panel framing system and some exemplary dimensions of the base element, according to an aspect.

FIG. 4 illustrates the cross-sectional view of the base element 401 of the security panel framing system and some exemplary dimensions in inches of the base element, according to an aspect. Also shown as an example is an exemplary angle that the base 401 may be constructed with.

Figure 5:
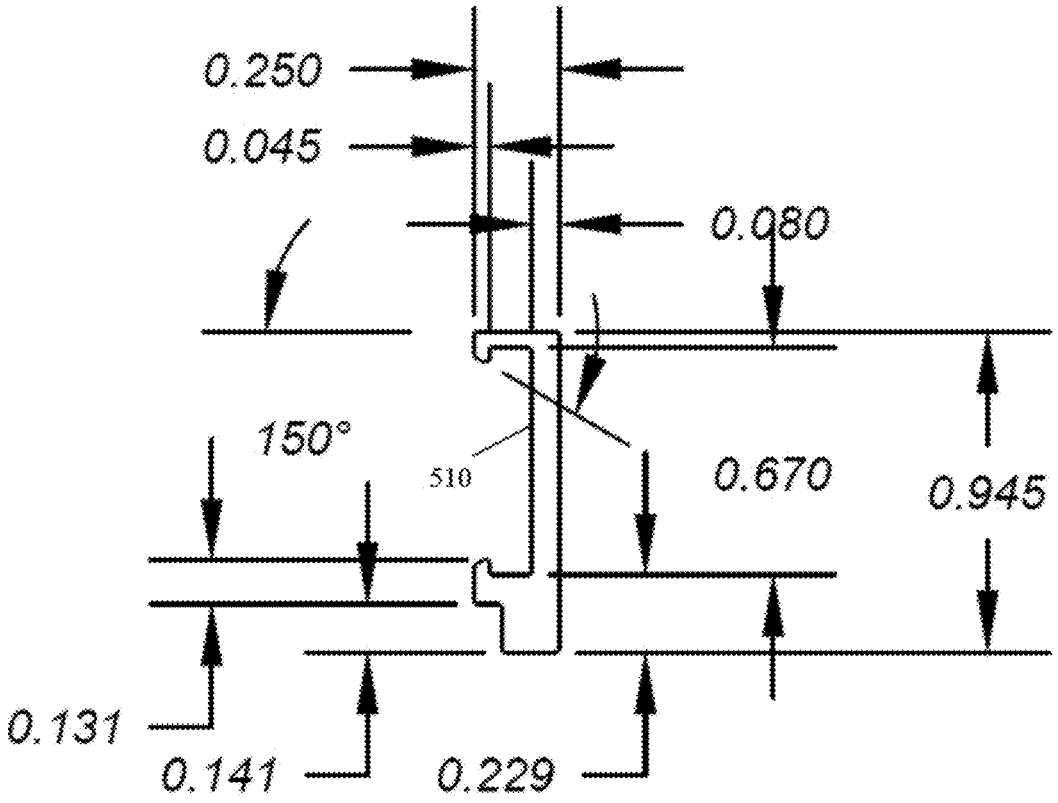
FIG. 5 illustrates the cross-sectional view of the wedge element of the security glass framing system and some exemplary dimensions of the wedge element, according to an aspect.

FIG. 5 illustrates the cross-sectional view of the wedge element 510 of the security glass framing system and some exemplary dimensions in inches of the wedge element 510, according to an aspect. Also shown as an example is an exemplary angle that the wedge 510 may be constructed with.

Figure 6:
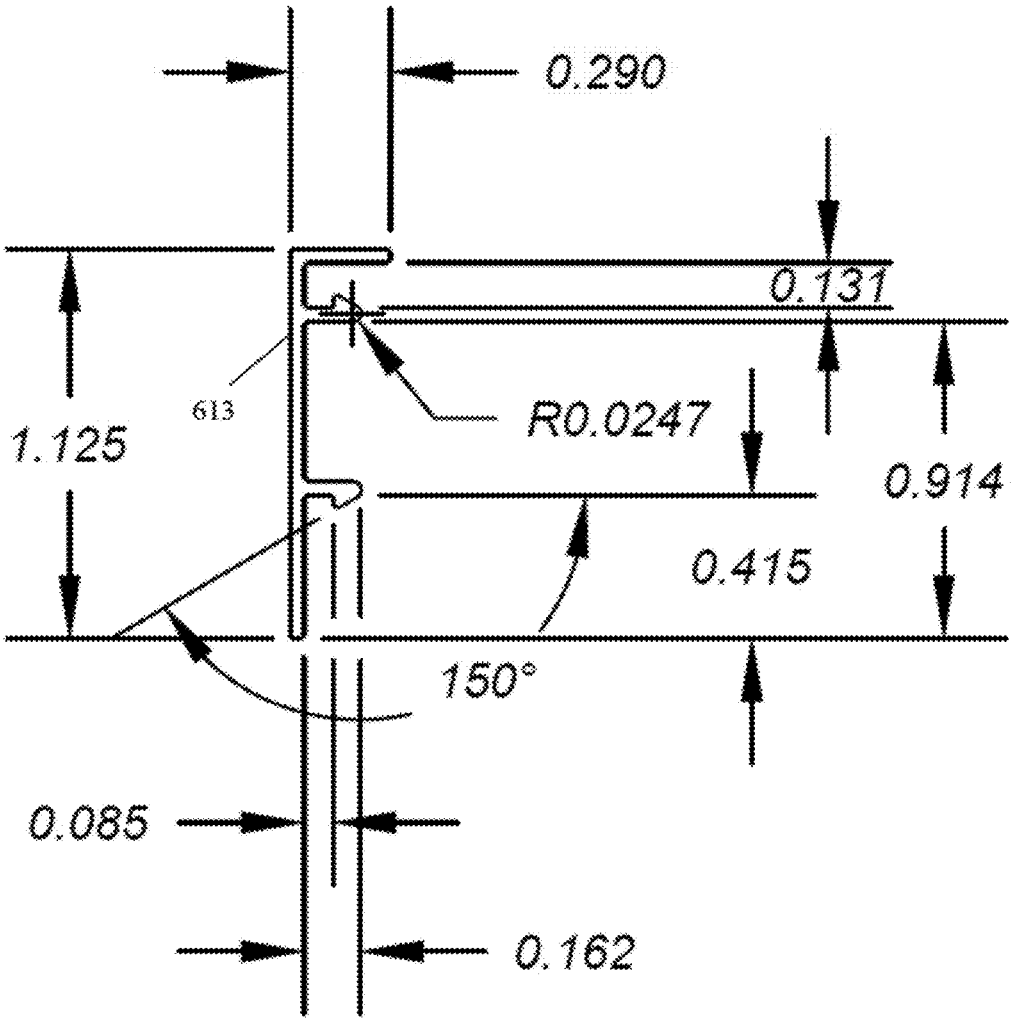
FIG. 6 illustrates the cross-sectional view of the cap element of the security panel framing system and some exemplary dimensions of the cap element, according to an aspect.
Figure 7A:
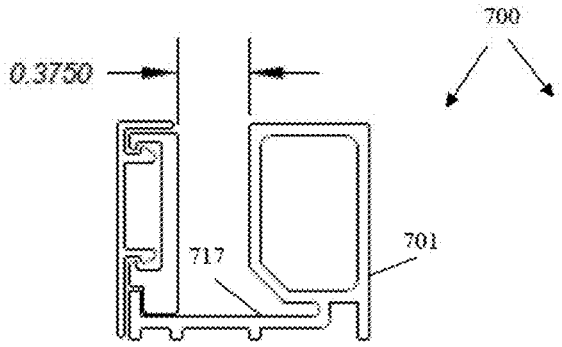
FIGS. 7A-7D illustrate four exemplary alternative embodiments of the security panel framing system, according to an aspect.
Figure 7B:
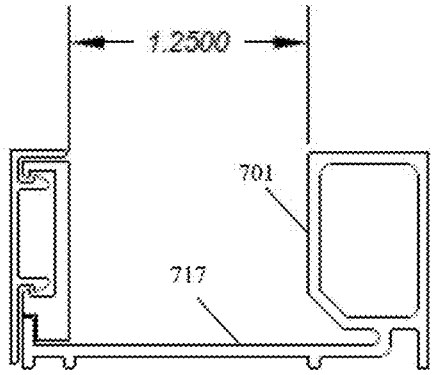
Figure 7C:
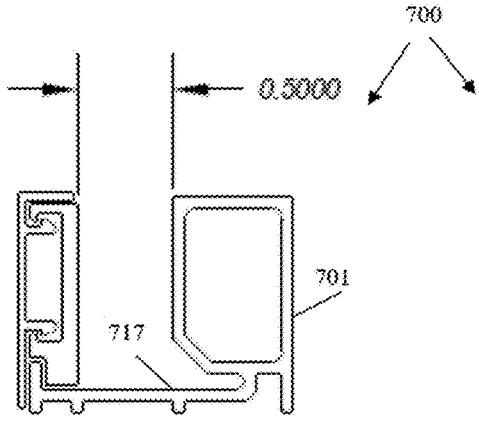
Figure 7D:
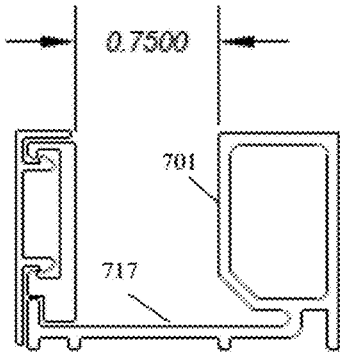

FIG. 6 illustrates the cross-sectional view of the cap element 613 of the security panel framing system and some exemplary dimensions in inches of the cap element 613, according to an aspect. Also shown as an example is an exemplary angle that the cap 613 may be constructed with.

FIGS. 7A-7D illustrate four exemplary alternative embodiments of the security panel framing system 700, according to an aspect. The security panel framing system 700 may be adapted to receive security panels having different thicknesses, such as the exemplary thicknesses shown, in inches. Alternative embodiments of the system may include a base 701 having a longer base plate 717 than the example shown in FIG. 1 in order to accommodate a thicker security panel. Alternatively, a base plate 717 may be shorter than the example shown in FIG. 1 if a thinner security panel is to be used in the security panel framing system 700.

Figure 8A:
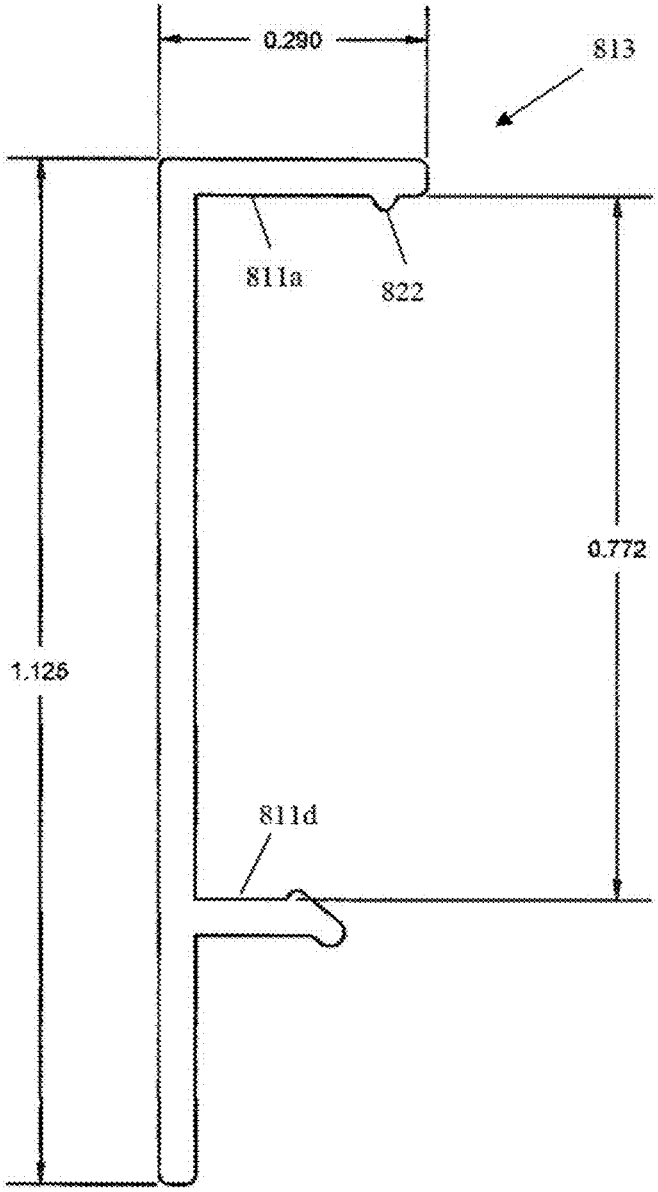
FIGS. 8A-8C illustrate the side view of another example of the cap, the side view of another example of the wedge, and an assembled side view of the cap with the wedge, respectively, according to an aspect.
Figure 8B:
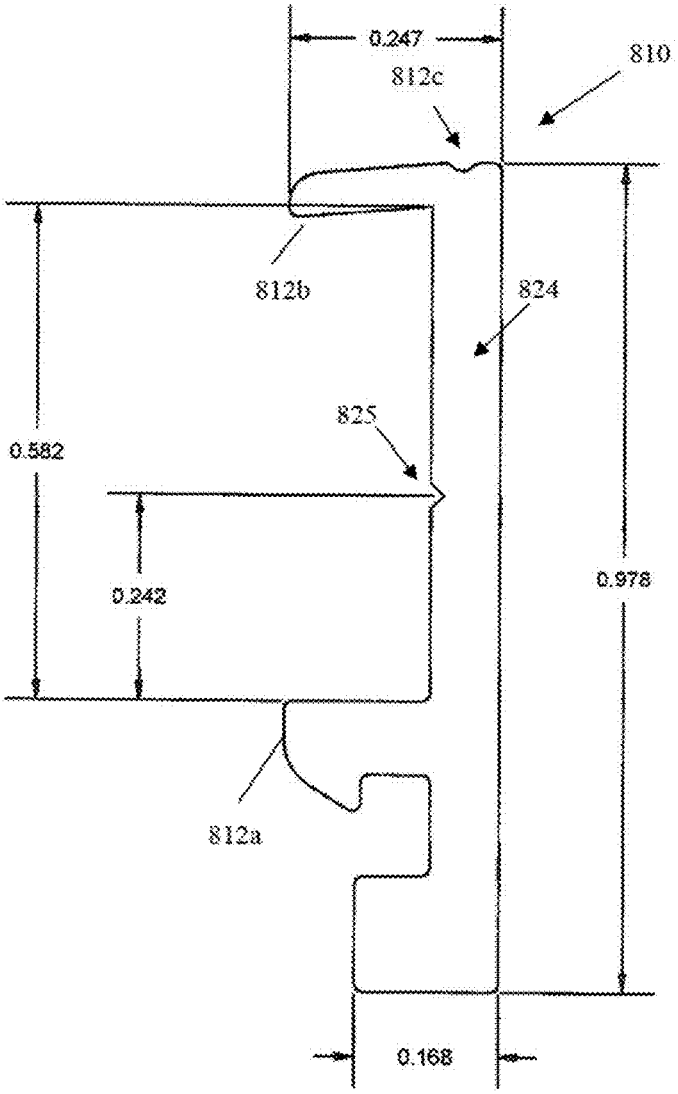
Figure 8C:
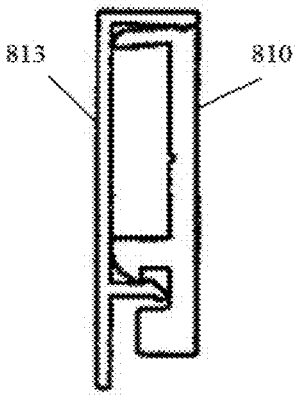

FIGS. 8A-8C illustrate the side view of another example of the cap 813, the side view of another example of the wedge 810, and an assembled side view of the cap 813 with the wedge 810, respectively, according to an aspect. FIGS. 8A-8B also show some exemplary dimensions in inches of the various components shown. Similar to the example of the cap 113 shown in FIG. 1, the cap 813 as shown in FIG. 8A may alternatively be provided with two portions or protrusions that extend outwards: an upper prong 811*a* and a lower prong 811*d*. The upper prong 811*a* may be provided with a bead 822. An advantage of two protrusions as opposed to the three as shown in FIG. 1 may be that less materials may be needed to construct the cap 813. The cap 813 may thus weigh less, and may be more cost efficient to produce.

The cap 813 as shown in FIG. 8A may be paired with or snap into a correspondingly shaped wedge 810 as shown in FIG. 8B. As an example of a corresponding wedge, the wedge may be provided with an alternative embodiment of a lower wedge lip 812*a*, and a top wedge lip 812*b* having a notch 812*c*. The notch 812*c* may be located on a top side of the top wedge lip 812*b*, such that it can receive the bead 822, and the lower wedge lip 812*a* may be shaped to correspond with the lower prong 811*d* of the cap 813.

The wedge 810 may be provided with pre-drilled holes (not shown) in the wall 824 of the wedge, which may be used for installing screws, such as the example shown by 115 in FIG. 1. Again, the wedge 810 may have holes pre-drilled in the center section or midsection of the wall 824 along its entire length, usually every 6"-8", and one such hole may occur where screw 115 is shown as an example in FIG. 1. Again, as discussed in paragraph 0031, each component of the security panel framing system may be provided in larger pieces which may then be cut down to size by a user according to their needs, such that any size window or glass panel may be protected by the system. When cutting down the wedge piece, a user may need to drill additional holes into the wedge if the cutting of the wedge removed too many holes, or if the wedge was not provided with pre-drilled holes. The wedge wall 824 may also be provided with an indent or groove which may be V-shaped ("V-groove," "groove," or "indent") 825 along the length of the wall (as represented by 220 in FIG. 2A). The groove may serve as a guide for a user who needs to drill additional holes for screws, for example. The groove may help a drill to be placed at the correct position for the holes. The groove 825 may be provided along the entire length of the wedge such that when the wedge is cut to a suitable size, the guide for the drill is present even after the wedge is cut.

As shown in FIG. 8C, the wedge 810 and the cap 813 may be associated together. As discussed when referring to FIG. 1, a force may be applied by the user to the cap 813 in order to snap the cap 813 onto the edge 813.

Figure 9A:
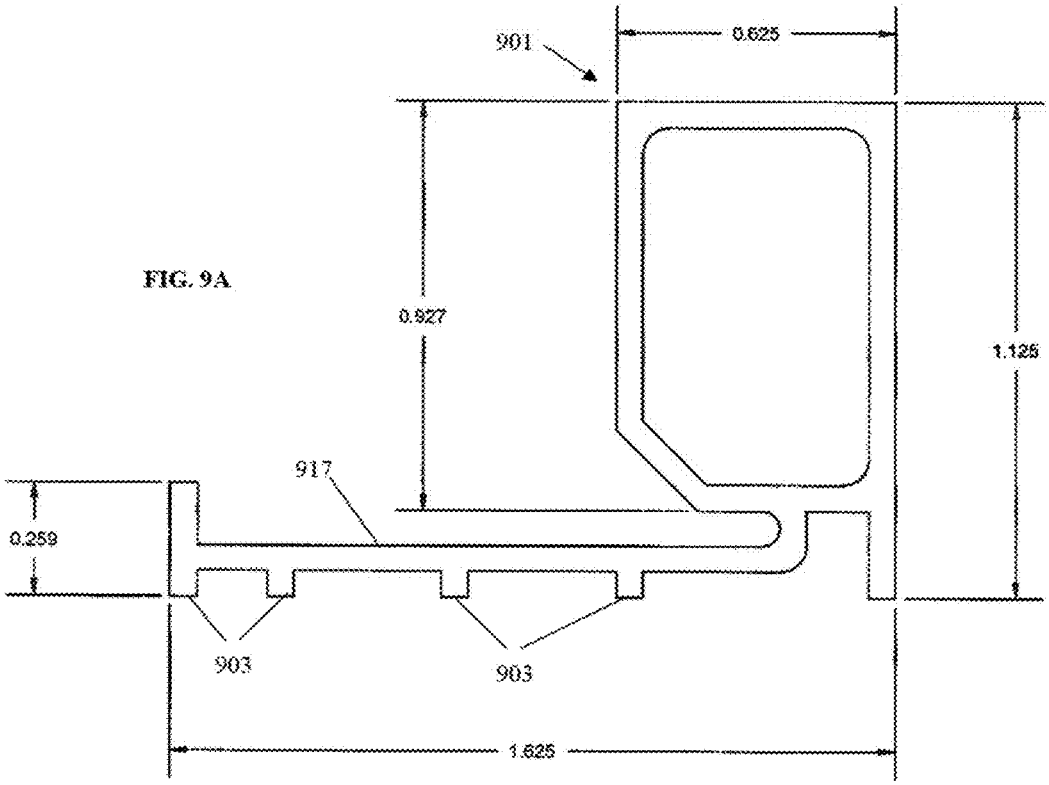
FIG. 9A illustrates the side view of another example of a base element, according to an aspect.

FIG. 9A illustrates the side view of another example of a base element 901, according to an aspect. Again, a base element 901 may be provided with a longer base plate 917 than the example shown in FIG. 1 in order to accommodate a thicker security panel, for example. A longer base plate 917 may include additional protrusions or legs 903. As an example, the base element 901 may be provided with four protrusions 903. The longer that a base plate 917 is, the more balance may be needed, and additional protrusions 903 may help to stabilize the base plate 917.

Figure 9B:
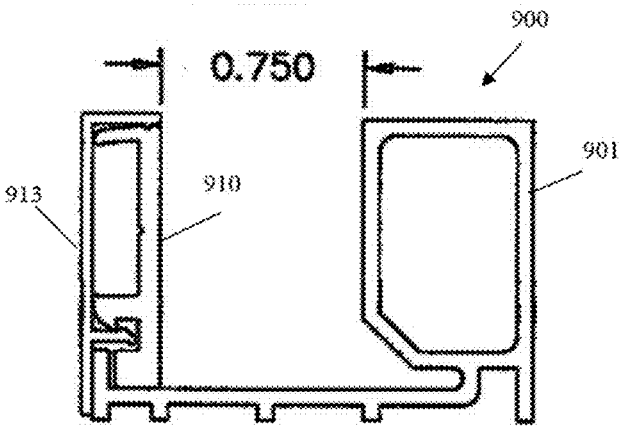
FIG. 9B illustrates the side view of an assembled security panel framing system using the base element of FIG. 9A, and the wedge and cap configuration of FIG. 8C, according to an aspect.

FIG. 9B illustrates the side view of an assembled security panel framing system 900 using the base element 901 of FIG. 9A, and the wedge 910 and cap 913 configuration of FIG. 8C, according to an aspect. FIGS. 9A-9B also show some exemplary dimensions in inches of the various components shown.

Figure 10A:
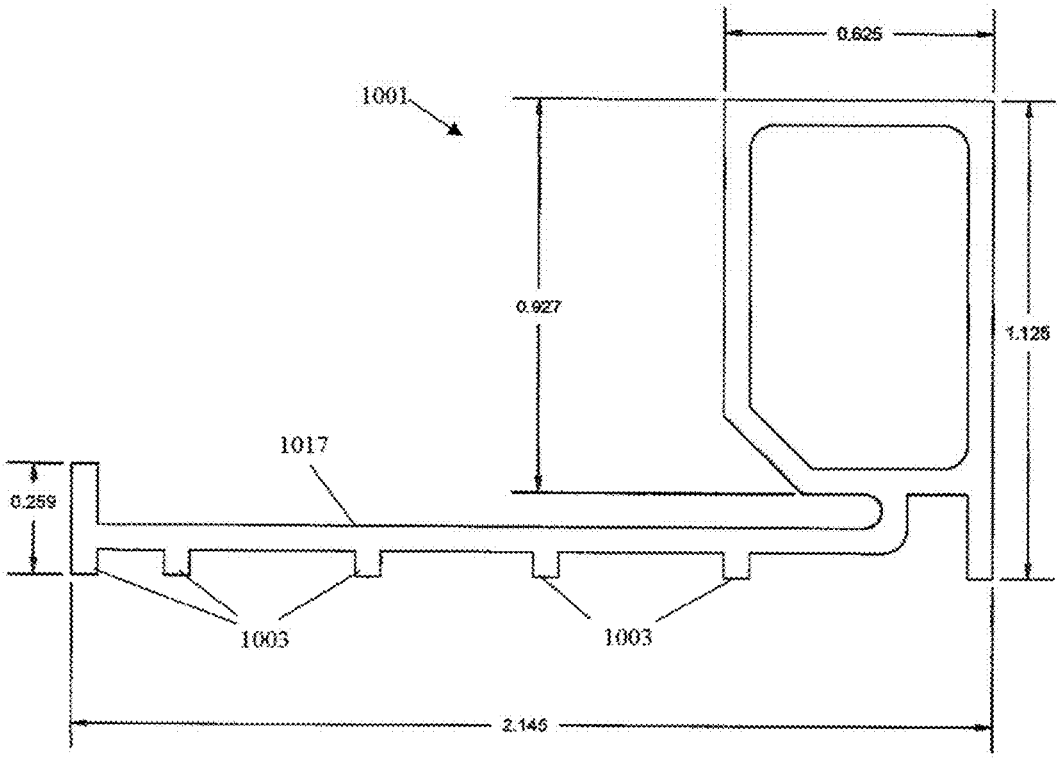
FIG. 10A illustrates the side view of another example of a base element, according to an aspect.

FIG. 10A illustrates the side view of another example of a base element 1001, according to an aspect. A base element 1001 may be provided with a longer base plate 1017 than the example shown in FIG. 9A in order to accommodate a thicker security panel, for example, and may be provided with, for example, five protrusions. It should be understood that any suitable number of protrusions may be provided for the base plate 1017 in order to provide a sufficient amount of stability to the system.

Figure 10B:
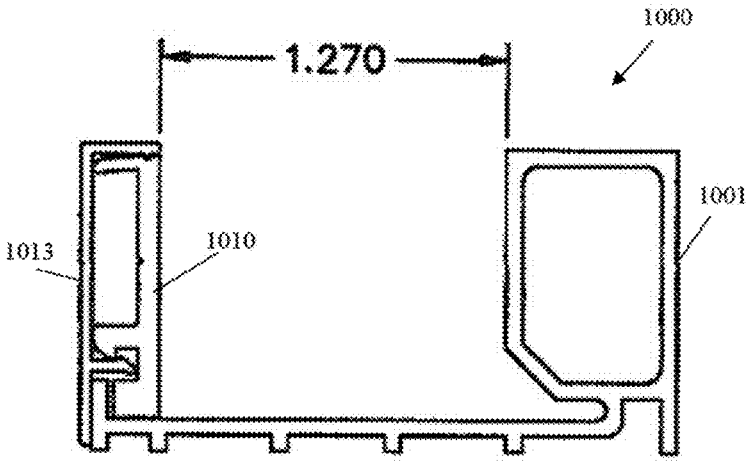
FIG. 10B illustrates the side view of an assembled security panel framing system 1000 using the base element of FIG. 10A, and the wedge and cap configuration of FIG. 8C, according to an aspect.

FIG. 10B illustrates the side view of an assembled security panel framing system 1000 using the base element 1001 of FIG. 10A, and the wedge 1010 and cap 1013 configuration of FIG. 8C, according to an aspect. FIGS. 10A-10B also show some exemplary dimensions in inches of the various components shown.

It should be understood that dimensions other than those shown in FIGS. 3-10B may be used to suit a particular application of the security panel framing system. For example, the security glass framing system may be fabricated and offered in various sizes to accommodate various thicknesses of the security panel used, which may include ¼"(inch) thickness as shown in FIG. 3, ¼", ⅜", ½", 3/4, 1" and 1¼". Again, FIGS. 7A-7D, and FIGS. 8A, 8B, and 9A-10B also show additional examples of dimensions that the security panel framing system may be constructed in. It should also be understood that any suitable snap-together or locking system may be used for association of the cap element to the wedge element.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. As used in this application, "and/or" means that the listed items are alternatives, but the alternatives also include any combination of the listed items.

The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. The terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases.

Acts, elements and features discussed only in connection with one aspect, embodiment or example are not intended to be excluded from a similar role(s) in other aspects, embodiments or examples.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A security panel framing system comprising:

a base having:

a base frame having a base frame front side, a base frame back side, a base frame top side, and a base frame bottom side;

a base plate under the base frame bottom side and extending past the base frame front side, the base plate having a base plate front side, a base plate back side, a base plate top side, a base plate bottom side, and a stopper at the base plate front side; the stopper having a stopper front side and a stopper back side;

a plurality of legs along and extending downwards from the base plate bottom side, such that a plurality of spaces is formed between the legs, wherein a first leg of the plurality of legs is substantially aligned with the stopper, and wherein at least one space of the plurality of spaces is larger than the other spaces of the plurality of spaces;

a hollow inner channel defined by the base frame front side, the base frame back side, the base frame top side, and the base frame bottom side;

a wedge having:

a wedge front side, a wedge back side, a wedge top side, and a wedge bottom side;

an upper wedge lip at the wedge top side;

a wedge wall extending between the wedge top side and the wedge bottom side;

a reinforced end at the wedge bottom side;

a lower wedge lip above the reinforced end;

wherein the reinforced end and the bottom wedge lip are configured to fit around and be held by the stopper back side on the base frame; and a cap configured to be associated with the wedge front side by having a plurality of prongs corresponding with the upper wedge lip and the lower wedge lip, wherein the cap covers a front end of the security panel framing system; and wherein the wedge is configured to sit at the base plate front side leaving a gap between the wedge back side and the base frame front side, the gap being configured to receive a portion of a security panel, such that the portion of the security panel is snugly encased by the base frame and the wedge.

2. The security panel framing system of claim 1, wherein the base frame bottom side comprises a first bottom edge and a second slanted bottom edge, wherein the first bottom edge is substantially parallel with the base plate, and the second slanted bottom edge is positioned at an angle with respect to the first bottom edge.

3. The security panel framing system of claim 1, further comprising:

a first plurality of screws; and a second plurality of screws;

wherein the first plurality of screws is installed through the base plate and into a frame for a glass, and the second plurality of screws is installed through the wedge wall and into the security panel.

4. The security panel framing system of claim 1, the plurality of prongs of the cap comprising an upper prong having a bead, and a lower prong; and wherein the upper wedge lip further comprises a notch configured to receive the bead such that the cap is locked onto the wedge.

5. The security panel framing system of claim 1, wherein the plurality of prongs of the cap comprises an upper arm, an upper prong, and a lower prong.

6. The security panel framing system of claim 1, the wedge wall further comprising a groove extending along a length of the wedge, the groove being positioned at a midpoint between the upper wedge lip and the lower wedge lip.

7. The security panel framing system of claim 6, the groove further comprising a plurality of screw holes.

8. The security panel framing system of claim 1, wherein the security panel framing system is constructed from anodized aluminum.

9. The security panel framing system of claim 1, further comprising a sealant applied into the plurality of spaces.

10. The security panel framing system of claim 1, further comprising a desiccant housed within the hollow inner channel.

11. A security panel framing system comprising:

a wedge having:

a wedge front side, a wedge back side, a wedge top side, and a wedge bottom side;

a wedge wall extending between the wedge top side and the wedge bottom side;

an upper wedge lip at the wedge top side;

a reinforced end at the wedge bottom side;

a lower wedge lip above the reinforced end;

wherein the reinforced end and the bottom wedge lip are configured to fit around and be held by a back side of a stopper on a base frame; and a cap configured to be associated with the wedge front side by having a plurality of prongs, wherein the cap covers a front end of the security panel framing system; and wherein the wedge back side is configured to align against a security panel, such that a portion of the security panel is snug against the wedge back side.

12. The security panel framing system of claim 11, further comprising a base having:

the base frame having a base frame front side, a base frame back side, a base frame top side, and a base frame bottom side;

a base plate under the base frame bottom side and extending past the base frame front side, the base plate having a base plate front side, a base plate back side, a base plate top side, a base plate bottom side, and the stopper at the base plate front side;

a hollow inner channel defined by the base frame front side, the base frame back side, the base frame top side, and the base frame bottom side;

wherein the portion of the security panel is snugly encased between the wedge back side and the base frame front side.

13. The security panel framing system of claim 11, the wedge wall further comprising a groove extending along a length of the wedge, the groove being positioned at a midpoint between the upper wedge lip and the lower wedge lip.

14. The security panel framing system of claim 13, the groove further comprising a plurality of screw holes.

15. The security panel framing system of claim 11, further comprising: a first plurality of screws, and a second plurality of screws, wherein the first plurality of screws is installed through the base plate and into a frame for a glass, and the second plurality of screws is installed through the wedge wall and into the security panel.

16. A method of installing a security panel on a frame for a glass, using a security panel framing system comprising:

a base having:

a base frame having a base frame front side, a base frame back side, a base frame top side, and a base frame bottom side;

a base plate under the base frame bottom side and extending past the base frame front side, the base plate having a base plate front side, a base plate back side, a base plate top side, a base plate bottom side, and a stopper at the base plate front side the stopper having a stopper front side and a stopper back side;

a plurality of legs along and extending downwards from the base plate bottom side, such that a plurality of spaces is formed between the legs, wherein a first leg of the plurality of legs is substantially aligned with the stopper, and wherein at least one space of the plurality of spaces is larger than the other spaces of the plurality of spaces;

a hollow inner channel defined by the base frame front side, the base frame back side, the base frame top side, and the base frame bottom side;

a wedge having:

a wedge front side, a wedge back side, a wedge top side, and a wedge bottom side;

a wedge wall extending between the wedge top side and the wedge bottom side;

an upper wedge lip at the wedge top side;

a reinforced end at the wedge bottom side;

a lower wedge lip above the reinforced end;

wherein the reinforced end and the bottom wedge lip are configured to fit around and be held by the stopper back side on the base frame; and a cap configured to be associated with the wedge, wherein the cap covers a front end of the security panel framing system; and wherein the wedge is configured to sit at the base plate front side leaving a gap between the wedge back side and the base frame front side, the gap being configured to receive a portion of a security panel, such that the portion of the security panel is snugly encased by the base frame and the wedge; the method comprising the steps of:

measuring the frame for a glass to obtain a first length;

associating the base, the wedge, and the cap together into a unit;

cutting the base, the wedge, and the cap such that a length of the unit matches the first length;

applying the sealant to the base plate bottom side;

securing the base to the frame for a glass;

providing a security panel sized to fit the frame for a glass;

holding the security panel in place on top of the base plate and against the base frame;

placing the wedge;

holding the cap against the wedge; and pushing a force on the cap to associate the cap with the wedge.

17. The method of claim 16, further comprising the step of repeating the applying step and the securing step such that a second base is installed on an opposite end of the security panel framing system; and further comprising the step of repeating the holding the security panel step, the placing step, the holding the cap step, and the pushing step.

18. The method of claim 16, the security panel framing system further comprising a first plurality of screws, and a second plurality of screws, the method further comprising the steps of:

installing the first plurality of screws through the base plate and into the frame for a glass; and installing the second plurality of screws through the wedge wall and into the security panel.

19. The method of claim 16, wherein the cap comprises a plurality of prongs; and wherein after the holding the cap against the wedge step, a portion of the cap contacts a front side of the first leg, and an end of a top prong of the plurality of prongs contacts the security panel; the method further comprising the steps of:

applying a first silicone bead to the front side of the first leg; and applying a second silicone bead to the end of the top prong.

20. The method of claim 16, further comprising the step adding a desiccant into the hollow inner channel.

* * * * *